United States Patent [19]

Magnusson

[11] Patent Number: 4,995,649

[45] Date of Patent: Feb. 26, 1991

[54] LOCKING DEVICE FOR SLIDING PANELS

[76] Inventor: Claes Magnusson, Vanadisvägen 43, S-113 23 Stockholm, Sweden

[21] Appl. No.: 496,160

[22] Filed: Mar. 19, 1990

Related U.S. Application Data

[63] Continuation of Ser. No. 309,291, Feb. 13, 1989, abandoned.

[51] Int. Cl.[5] ..... E05C 1/10

[52] U.S. Cl. ..... 292/175; 292/341.17; 292/DIG. 46

[58] Field of Search ..... 292/106, 191, 192, 341.17, 292/175, 302, 305, DIG. 46, 207

[56] References Cited

U.S. PATENT DOCUMENTS

| | | | |
|---|---|---|---|
| 1,192,449 | 7/1916 | Ottinger | 292/191 |
| 1,987,076 | 1/1935 | Pulis | 292/106 X |
| 2,575,465 | 11/1951 | Patton | 292/341.17 X |
| 2,796,279 | 6/1957 | Schlor | 292/341.17 |
| 2,868,551 | 1/1959 | Avellone et al. | 292/304 X |
| 2,964,344 | 12/1960 | Rich | 292/175 |
| 3,612,592 | 10/1971 | Reitzel | 292/175 |
| 4,752,091 | 6/1988 | Jackson | 292/191 X |

*Primary Examiner*—Richard E. Moore

[57] ABSTRACT

A locking device comprises a lock assembly which is received in a housing adapted to be mounted in a recess in an edge of a sliding panel. The lock assembly contacts a closure member, such as jamb or similar panel, and a latch member is adapted to be mounted in the closure member. The locking device is primarily, but not exclusively, intended for use in connection with yacht hatches.

9 Claims, 5 Drawing Sheets

III
V
1
2
3
4
5
6
7
8
9
10
11
12
13
14
15
33
38
39
40
41
42
45
46
47
48
49
50
51
52
56
57
58
59
60
63
65
67
68
69
70
71
72
73
74
75
76

LOCKING DEVICE FOR SLIDING PANELS

This application is a continuation of application Ser. No. 309,291, filed on Feb. 13, 1989, now abandoned.

BACKGROUND OF THE INVENTION

1. Field of the Invention

The present invention concerns locking devices useful for keeping sliding panels such as sliding doors, windows, hatches and the like in closed position in their surrounding frames.

More specifically, the locking device of the present invention is of the kind comprising a lock assembly received in a housing adapted to be mounted in a recess in an edge of a sliding panel for contact with a closure member, such as a jamb or a meeting similar panel, and a latch member adapted to be mounted in said closure member. Primarily, but not exclusively, the locking device of the present invention is intended for use in connection with yacht hatches.

2. Description of Background Art

Locking devices of the kind stated are known from U.S. Pat. Nos. 2,575,485 (Patton) and 2,964,344 (Rich).

Patton discloses a locking device in which a latch mechanism, normally engageable to yieldably hold a door closed, is positively retained against disengagement by a slidable dogging bolt to lock the door. Unless positively locked by means of the slidable dogging bolt, which is operated by a rotatable knob protruding from the door, the latch mechanism of this device allows a door to open due to vibrations or shocks. This may be the case for instance in a marine application when cruising at high speeds in heavy seas. Also in a marine application, protruding knobs may cause injury to the crew, further the knobs may be struck by failing objects or otherwise cause fatal malfunctioning in the case of an emergency.

Rich discloses a latch construction including a latching hook mounted in a side jamb and a U-shaped, elongated latching member mounted in a panel. Latching is accomplished by pivotal movement of the latching hook to engage in an opening in the U-shaped member, whereas unlatching is accomplished by pushing downward on either of two extremely cumbersome handles acting on the U-shaped member to cause lowering thereof to disengage said opening from the latching hook. Thus, apart from pushing a handle downwards to cause unlatching, it is also necessary to push the handle in a horizontal direction to open the panel.

OBJECT OF THE INVENTION

It is an object of the present invention, thus, to provide a locking device of the type indicated which may be mounted completely flush with a panel.

It is another object of the invention to provide a locking device which accomplishes positive self-locking latching upon closing of a sliding panel.

A further object of the invention is to provide a locking device which enables unlatching by movement of a handle means in the direction of opening of a panel.

A still further object of the invention is to provide a lightweight locking device including a moderate number of parts, most of which lend themselves to manufacture in an economically favourable way, preferably by utilizing corrosion resistive materials also having aesthetically attractive properties.

These and other objects and advantages of the invention will become apparent from the following description of a preferred embodiment and the accompanying drawings.

DETAILED DESCRIPTION OF THE DRAWINGS

Figure 7:
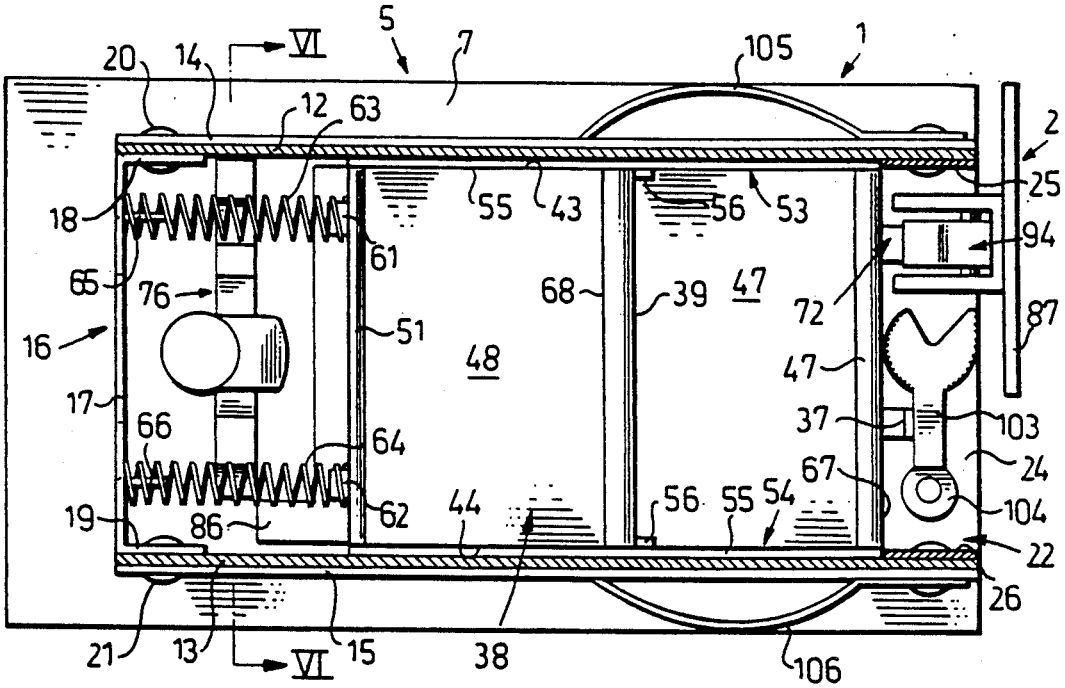
FIG. 7 is an inside view of the lock assembly and the latch member with mounting means therefor as seen with the outside wall of the housing being removed.

The locking device of the present invention comprises two parts, viz., a lock assembly 1 and latching means 2. The lock assembly is received in a housing 3 comprising an outside part 4 and an inside part 5 both having generally rectangularly shaped planar walls 6 and 7, respectively, with upper and lower edges 8, 9 and 10, 11, respectively, and further having on their facing sides mutually parallel upper and lower flanges 12, 13 and 14, 15, respectively, extending in the longitudinal direction of the housing to terminate in one end at the forward end of the housing and in the other end at distance from the backward end thereof, as seen in FIG. 7. The flanges are disposed in overlapping relationship such that the flanges 12 and 13 of the outside part 4 define upper and lower inner walls of the housing, respectively.

Figure 6:
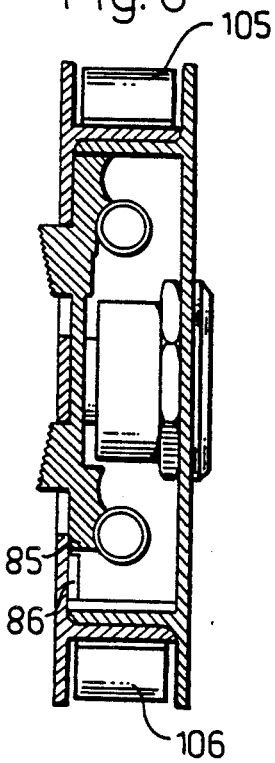
FIG. 6 is a section taken along the line VI—VI of FIG. 7.

As will be appreciated when studying the sectional view of FIG. 6, both housing parts 4 and 5 have sectional shapes well suited for extrusion from any extrudable material, such as aluminum. In working the invention, thus, it is preferred to manufacture the housing parts from correspondingly shaped extruded profiles which are cut in appropriate lengths.

The backward end of the housing 3 is closed by a generally U-shaped member 16 having a flat portion 17 bridging the flanges 12 and 13 of the outer housing part 4, and flanges 18 and 19 introduced between the flanges 12 and 13 in abutting relationship therewith. In the backward end of the housing the upper flanges 12 and 14 and the lower flanges 13 and 15 of the housing parts 4 and 5, respectively, are interconnected by means of any conventional fastening means such as screws or rivets 20 and 21, respectively, also securing the flanges 18, 19 of the U-shaped member 16 to the housing.

Figure 8:
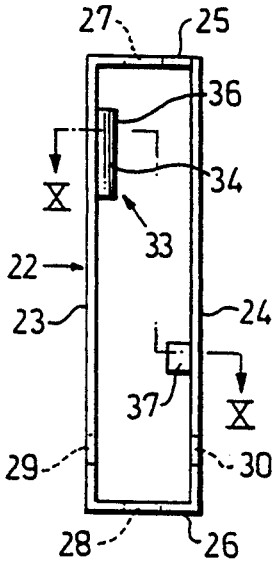
FIG. 8 is a separate view at an enlarged scale of the lock pillar seen as in FIG. 5.
Figure 9:
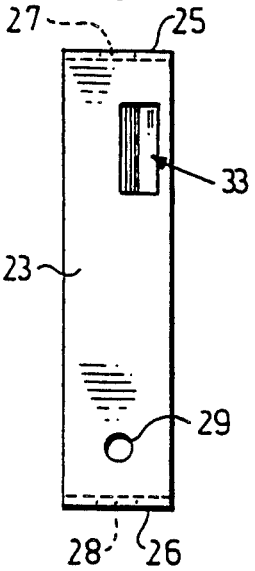
FIG. 9 is a side view of the lock pillar.
Figure 10:
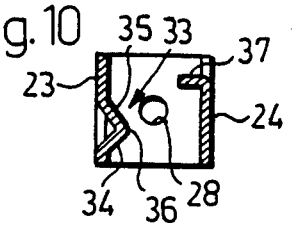
FIG. 10 is a section taken along line X—X of FIG. 8.

In the forward end of the housing is introduced a rectangularly shaped lock pillar 22, preferably being a bent sheet metal member, separately shown in FIGS. 8–10 and having mutually parallel longer walls 23, 24 and likewise mutually parallel shorter walls 25, 26, the upper shorter wall 25 abutting a free end of longer wall 24. Vertical bores 27, 28 extend centrally through upper and lower shorter walls 25, 26, respectively, and horizontally aligned bores 29, 30 extend through longer walls 23, 24, respectively. The upper and lower shorter walls 25, 26 of the pillar 22 are secured to the housing by any conventional fastening means, such a rivets 31 and 32, respectively, also interconnecting the upper flanges 12 and 14 and the lower flanges 13 and 15, respectively, of the housing.

An abutment member 33 protrudes inwardly from the longer wall 23 into the interior of the lock pillar 22. The abutment member 33 comprises two mutually inclined vertical cam surfaces 34, 35 meeting in an apex 36. The abutment member 33 may be a separate member welded or otherwise attached to the inner surface of the longer wall 23, but it is preferred that it is made integral with the wall 23 by being punched therein and inwardly pressed as shown in FIGS. 8–10.

A stop lug 37 protrudes inwardly from the longer wall 24 into the interior of the lock pillar 22. The stop lug 37 preferably is punched in the wall 24 and bent inwardly as shown in FIGS. 8 and 10.

Figures 1, 2, 3:
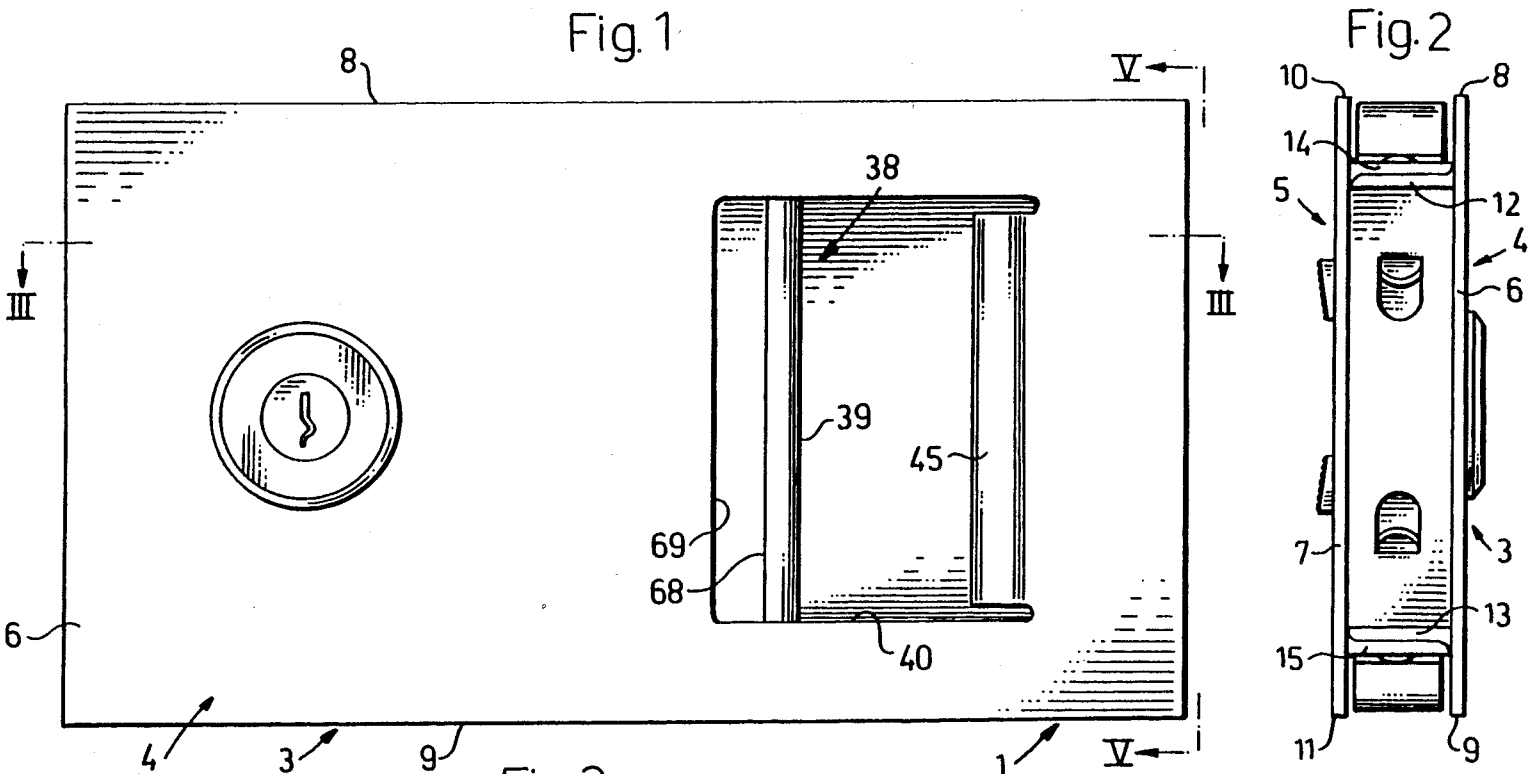
FIG. 1 is a front view of the lock assembly of the locking device.
FIG. 2 is an end view seen in the direction of arrow II of FIG. 1.
FIG. 3 is a section through the lock assembly taken along line III—III of FIG. 1 also showing the latch member.
Figure 4:
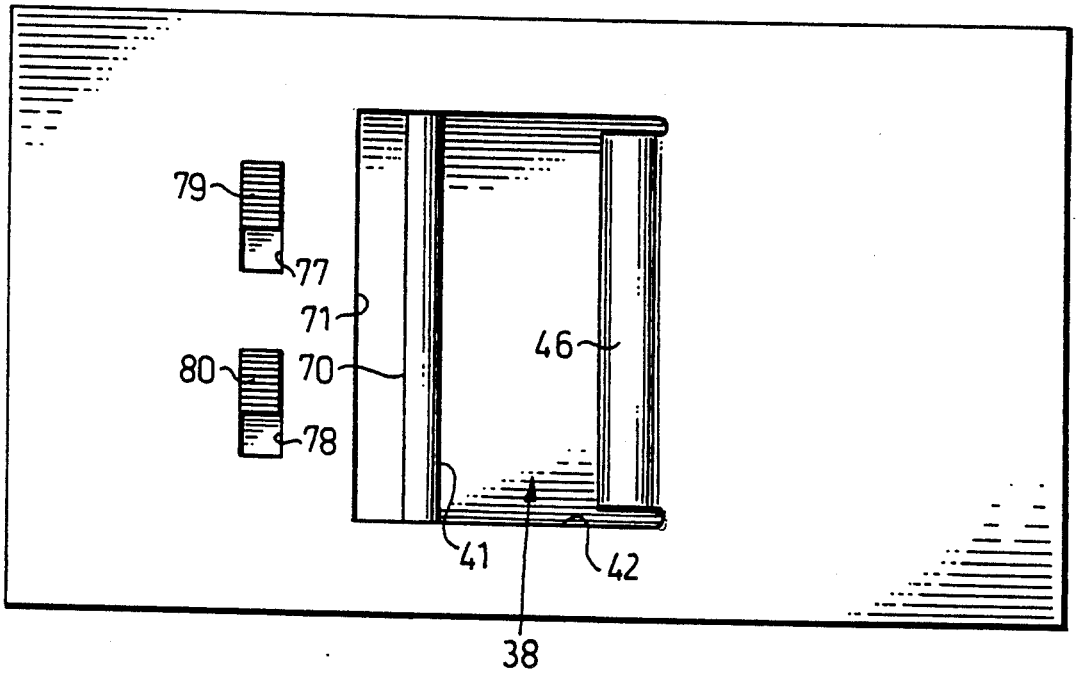
FIG. 4 is a rear view of the lock assembly.

Inside the housing is slidingly disposed a handle 38 having a handle portion 39 (FIGS. 1 and 3) accessible from outside the lock assembly through an aperture 40 in the wall 6 of the outside housing part 4, and a handle portion 41 (FIGS. 4 and 3) accessible from inside the lock assembly through an aperture 42 in the wall 7 of the inside housing part 5. As sen in FIG. 7, the handle 38 is generally rectangular having upper and lower parallel edges 43 and 44, respectively, the distance between which is slightly smaller than the distance between the upper and lower flanges 12, 13 of the wall 6 of the outside housing part 4. Preferably, the handle is an extruded profile, the section of which appears from FIG. 3. Also as seen in FIG. 3, the handle portions 39 and 41 protrude to a very small extent outside the respective aperture 40 and 42. The apertures 40 and 42 are cut out in the respective wall 6 and 7 of the housing parts, leaving a portion of the material of each wall opposite the respective handle portion 39, 41 to be bent to a smooth curve to serve as fixed handles 45 and 46, respectively. Flat portions 47, 48 of the handle 38 are disposed in sliding relationship with the outside and inside walls 6 and 7, respectively, of the housing. At the forward end of the handle 38 is provided an inwardly turned web portion 49 having a vertical partcylindrical channel 50 therein. On the back side of the handle portion 41 in an integral ridge 51 thereof is provided a further vertical part-cylindrical channel 52.

Figure 11:
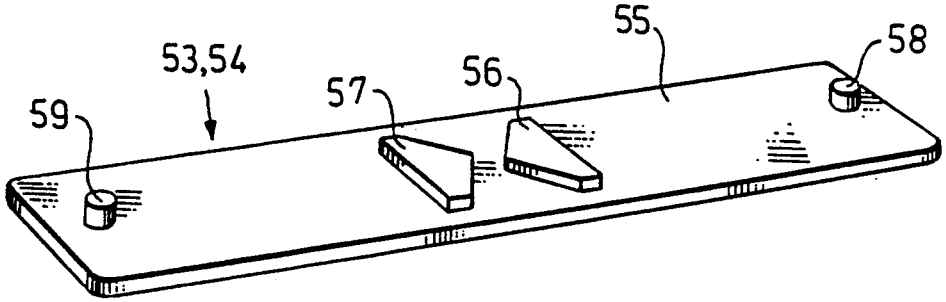
FIG. 11 is a perspective view of the guide member.

To minimize sliding friction between the handle 38 and the upper and lower flanges 12, 13 of the wall 6 of the outside housing part 4, guide members 53 and 54 (FIG. 11), respectively, made of any low-friction material, are interposed between the upper and lower edges 43 and 44, respectively, of the handle 38 and the flanges 12, 13.

Each guide member 53, 54 comprises a flat rectangular portion 55, two centrally disposed blocks 56 and 57, and, at the ends of the guide member, two cylindrical protrusions 58, 59. The blocks 56 and 57 are shaped so as to straddle a central web portion 60 of the handle 38 bridging handle portion 39 and the flat portion 47 thereof, and the cylindrical protrusions 58, 59 are dimensioned so as to be received in the part-cylindrical channels 50 and 52 of the web portion 49 and the ridge 51, respectively (FIG. 3). By means of the inter-engagement between the blocks 56, 57 and the central web portion 60 of the handle on one hand, and the cylindrical protrusions 58, 59 and the part-cylindrical channels 60, 62 on the other hand, the guide members 53, 54 are positively brought along by motion of the handle 38 to slide against the flanges 12, 13.

Supported with one end against a backward portion of the handle 38 and laterally kept in place by studs 61, 62 engaged in the part-cylindrical channel 52 are two vertically spaced compression springs 63, 64, the other ends of which engage with inwardly bent lugs 65, 66 punched in the flat portion 17 of the U-shaped member 16 closing the backward end of the housing 3. The springs 63, 64 urge the handle 38 towards the forward end of the housing (to the right in FIGS. 3 and 7) where it is positively retained by abutment between a forward edge 67 thereof and the pillar 24 on one hand, and between the guide members 53, 54 and the upper and lower walls 25, 26 of the pillar 24 on the other hand.

Backward movement of the handle 38, i.e., against the action of the springs 63, 64, is limited by abutment on one hand between a vertical surface 68 of the handle portion 39 and a vertical edge 69 defining the aperture 40 in the wall 6 of the housing part 4, and on the other hand between a vertical surface 70 of the handle portion 41 and a vertical edge 71 defining the aperture 38 in the wall 7 of the housing part 5.

In the forward end of the handle 38, and more precisely on the forward vertical surface of the web portion 49 thereof, is fixedly mounted a lock bolt 72. This lock bolt has a flat surface 73 sliding on the inside of the longer vertical wall 24 of the lock pillar 22, and an inclined surface 74 merging with a flat surface 75.

In order to limit backward movement of the handle 38 and, consequently, of the lock bolt 72, a vertically movable catch member 76 is slidably guided by two vertically spaced recesses 77, 78 in the wall 7 of the inside housing part 5. More precisely, the catch member 76 has two manually operable knobs 79, 80 extending through the wall 7 and slightly protruding on the inner side thereof. As will be apparent from FIGS. 4 and 6, vertical travel of the catch member 76 is limited by abutment between the knobs 79, 80 and the defining edges of the corresponding recesses 77, 78 in which they are received. The catch member 76 is yieldably retained in its upper and lower positions by snaplike engagement with the two springs 63, 64.

For this purpose, and as best seen in FIG. 6, the catch member is provided with two arcuate recesses for each spring, viz., an upper and a lower recess 81 and 82, respectively, for the upper spring 63, and an upper and a lower recess 83 and 84, respectively, for the lower spring 64. In FIG. 6 the catch member 76 is shown being kept in its upper position by engagement of the springs 63, 64 in the respective lower recess 82, 84. By moving the catch member 76 downwards, preferably by manually operating the lower knob 80, the springs 63, 64 will snap out of the recesses 82, 84 and engage in the recesses 81, 83 to keep the catch member in its lower position. In this position, the lower portion 85 of the catch member 76 will be positioned in the path of movement of a tab 86 extending backwards from the handle 38 so as to positively prevent backward movement of the handle 38 and the lock bolt 72 fixed thereto.

Figure 12:
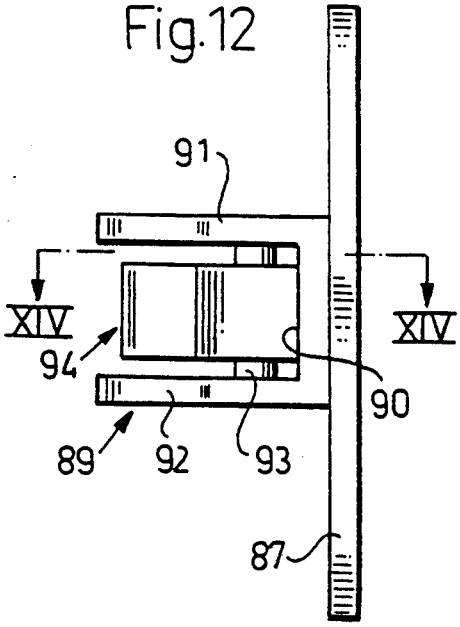
FIG. 12 is a side view of the latch member and its mounting means at an enlarged scale.
Figure 13:
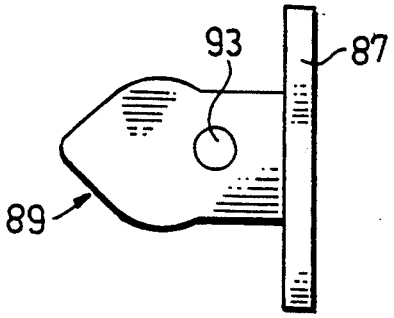
FIG. 13 is a top view of the mounting means of FIG. 12.
Figure 14:
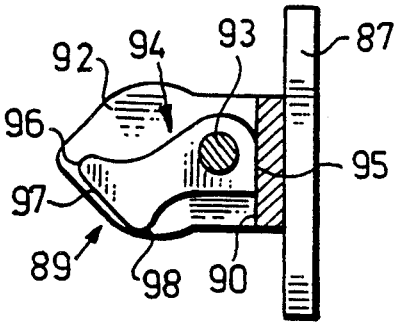
FIG. 14 is a section taken along line XIV—XIV of FIG. 12.

The latching means 2 of the locking device and mounting means therefor are shown separately in FIGS. 12–14. On a flat mounting plate 87 is fixedly attached guide mans 89 including a generally U-shaped body (FIG. 12) having a base portion 90 and two guide portions 91, 92 having a bulb-like configuration in plane view according to FIG. 13. On a shaft 93 extending between the guide portions 91, 92 and fixed thereto is pivotably journalled a latch member 94. The latch member is spring-loaded (spring means not shown) so as to normally be positioned as shown in FIG. 14. In this position, which is the operative position of the latch member, a flat portion 95 thereof rests on the base portion 90 of the guide means 89 preventing further pivoting in a counter-clockwise direction according to FIG. 14. The free end of the latch member 94 has a somewhat hook-like configuration with a head portion 95 having a round-pointed end 96, a sloping cam surface 97 and a rounded cam surface 98.

Figure 15:
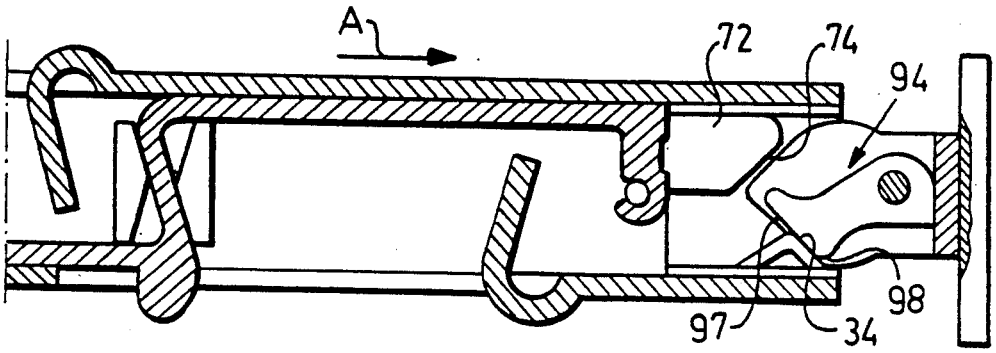
FIG. 15.
Figure 16:
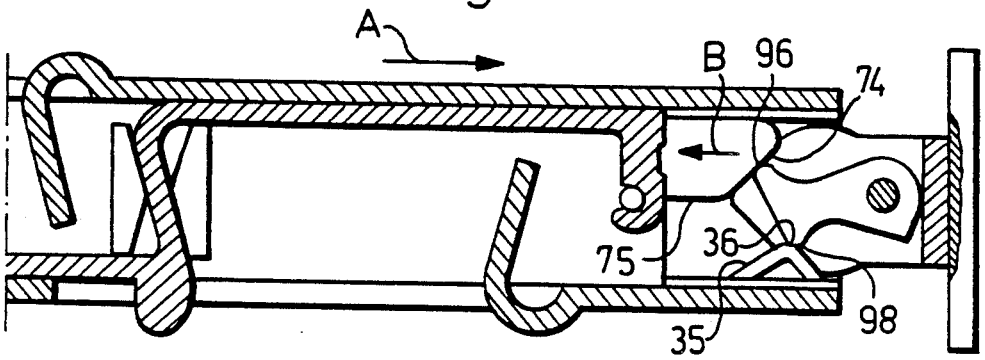
FIG. 16.
Figure 17:
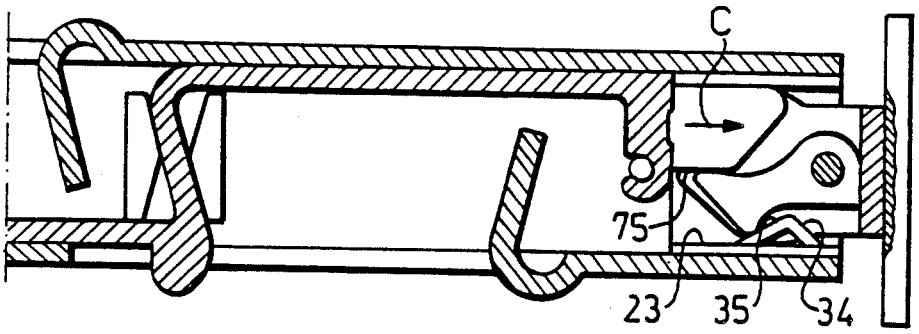
FIG. 17 are sectional views corresponding to that according to FIG. 3 but at an enlarged scale showing the function of the locking device.

The relationship between the lock assembly 1 and the latching means 2 of the locking device of the present invention as well as their junction is shown in detail in FIGS. 15, 16 and 17.

As is evident, the lock assembly is to be mounted in a suitable recess in a slidable panel, and the latching means in a recess in a corresponding jamb, neither of which is shown. When the panel is closed by pushing it in the direction of arrow A using either of the fixed handles 45, 46, and the lock lock assembly approaches the latching means, the bulb-like guide means 89 initially guides the longer vertical walls 23, 24 of the lock pillar 22 so as to give the lock assembly the proper direction towards the latching means 2. Upon further movement of the panel the cam surface 34 of the abutment member 33 encounters the sloping cam surface 97 of the latch member 94 (FIG. 15). Still further movement of the panel causes the sloping cam surface 97 of the latch member 94 to climb the abutment member 33 sliding against the cam surface 34 thereof, pivoting the latch member 94 clock-wise (FIG. 16) until the rounded cam surface 98 thereof reaches the apex 36 of the abutment member 33. During this movement, the round-pointed end 96 abuts the inclined surface 74 of the lock bolt 72 pressing the lock bolt 72 and the handle 38 backwards in the direction of the arrow B against the force of the springs 63, 64. Proceeded movement of the panel causes the rounded cam surface 98 to pass over the apex 36 of the abutment member 33 and to descend along the sloping cam surface 35 thereof (FIG. 17). During this movement, the round-ended point 96 of the latch member 94 slides against the inclined surface 74 of the lock bolt 72, assisted by its spring means, to completely leave engagement therewith when the rounded cam surface 98 of the latch member approaches the transition between the cam surface 35 of the abutment member 33 and the longer vertical wall 23 of the lock pillar 22. In this position, the latch member 94 releases the lock bolt 72 and the handle 38 to be pushed forward in the direction of the arrow C by the force of the springs 63, 64. In this position, the lock bolt 72 positively prevents pivoting of the latch member 94 in the clock-wise direction and, consequently, the panel is positively locked to the jamb by the unyieldable engagement between the rounded cam surface 98 of the latch member and the cam surface 35 of the abutment member 33.

As will be evident from the foregoing, unintended or accidental opening due to vibrations or shocks is effectively prevented by means of the locking device of the present invention. However, intended opening of the panel is easily achieved by pulling the handle 38 in the opening direction of the panel (to the left in FIGS. 3 and 15–17), either from outside the panel by operating the handle portion 39, or from inside the panel by operating the handle portion 41.

To prevent opening of the panel by operating the handle 38, movement of the handle can be positively prevented, as mentioned above, by manually pushing the catch member 76 downwards to block movement of the handle. Such blocking, however, is intended to be possible only from inside the panel, such as from inside a yacht cabin. In order to block movement of the handle from outside the panel, a conventional key-operated lock 99 is mounted in the wall 6 of the outside part 4 of the housing 3. This lock 99 comprises an arm 100 which acts on either of two shoulders 101, 102 provided on the catch member 76 to move the catch member upwards or downwards, respectively, to unblock or block movement of the handle in the opening direction.

Figure 5:
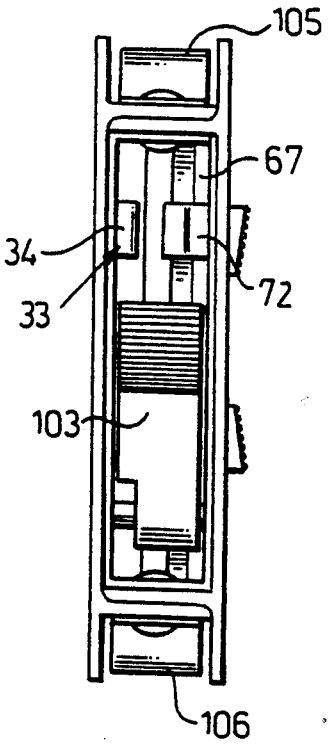
FIG. 5 is an end view seen in the direction of arrow V of FIG. 1.

When in a fully open position, a sliding panel is often entirely concealed in a wall or the like, only the forward edge of the panel being accessible. In order to grip a panel in such a position, the lock assembly 1 includes a handle 103 which is accessible through the forward end of the housing. The handle 103 is pivotable about a shell 104 from a position within the housing (FIGS. 5 and 7), where it is supported against the stop lug 37 provided in the lock pillar 22, to a position outside the housing, where it is easily gripped to pull the panel out of its concealed position. The shaft 104 is received in the bores 29, 30 of the lock pillar 22.

In order to accommodate the housing 3 in a recess in a panel, leaf springs 105 and 106 are provided on the upper and lower flanges 14, 15 of the inside housing part 5, said leaf springs being adapted to press against adjacent surfaces of the recess.

I claim:

1. A locking device for a sliding panel comprising:

a lock assembly received in a housing adapted to be mounted in a recess in an edge of the sliding panel for contact with a closure member, and a latch member adapted to be mounted in said closure member; said lock assembly including:

a lock bolt having a first end and a second end and being slidable within said housing and biassed by spring means in a first direction towards said closure member, and abutment means fixed in said housing and having a first cam surface and a second cam surface, said first end of said lock bolt and said abutment means defining a space therebetween;

said latch member including first and second cam surfaces and being pivotedly mounted so as to be resiliently urged from an inoperative first position towards an operative second position;

wherein sliding said panel towards a closed position against said closure member causes said first cam surface of said abutment means to initially slidably engage said first cam surface of said latch member to move said latch member to said first position, said latch member in said first position abutting said first end of said lock bolt to force said latch member in a second direction opposite to said first direction, thereby giving said latch member access to said space and enabling said latch member to pivot towards its operative position, said second cam surface of said latch member sliding against said second cam surface of said abutment means, said latch member in the operative position within said space releasing said lock bolt to be spring biassed in said first direction to positively prevent pivoting of said latch member towards the first position, thereby retaining said second cam surface of said latch member in engagement with said second cam surface of said abutment means.

2. A locking device according to claim 1, wherein said housing includes a first part and a second part, said first part comprising a plane portion having a first flange and a second flange protruding therefrom, and said second part comprising a plane portion having a first flange and a second flange protruding therefrom, said first and second flanges of said first and second parts being mutually parallel and disposed in overlapping relationship, said plane portion of said first part and said plane portion of said second part forming mutually parallel first and second sides of said housing, and said first flanges of said first and second parts and said second flanges of said first and second parts forming mutually parallel third and fourth sides of said housing, said first flange and said second flange of said first part forming inner guide means of said housing for guiding said lock bolt.

3. A locking device according to claim 2, wherein said lock bolt is fixed to handle means slidably guided along said guide means.

4. A locking device according to claim 3, wherein a wall means connects said third and fourth sides of said housing, said spring means being interposed between said wall means and said handle means.

5. A locking device according to claim 4, wherein a catch member moveable between a first and a second position is guided in said plane portion of said first part, said catch member being yieldably retainable in said first and said second positions by said spring means, said catch means in said first position allowing movement of said lock bolt in a second direction opposite to said first direction and in said second position preventing movement of said lock bolt in said second direction.

6. A locking device according to claim 5, wherein said catch member includes recess means to be engaged by said spring means.

7. A locking device according to claim 6, wherein said catch member extends through said plane portion of said first part to be accessible for manual operation, and a key-operated lock, is mounted in said plane portion of said second part to allow key operation of said catch member.

8. A locking device according to claim 2, wherein said first part and said second part are manufactured from extruded profiles cut in appropriate lengths to form said first and second parts.

9. A locking device according to claim 3, wherein said handle means is manufactured from an extruded profile cut in an appropriate length to form said handle means.

* * * * *